US005477803A

United States Patent [19]

Moody

[11] Patent Number: 5,477,803

[45] Date of Patent: Dec. 26, 1995

[54] TORPEDO TUBE AND SLIDE VALVE GRATES

[75] Inventor: Paul E. Moody, Barrington, R.I.

[73] Assignee: The United States of America as represented by the Secretary of the Navy, Washington, D.C.

[21] Appl. No.: 268,597

[22] Filed: Jun. 30, 1994

[51] Int. Cl.[6] ..... B63G 8/32

[52] U.S. Cl. ..... 114/316; 114/238; 137/544; 137/547

[58] Field of Search ..... 114/238, 316–319; 89/5, 1.809; 137/544, 547

[56] References Cited

U.S. PATENT DOCUMENTS 546,606 9/1895 Brainerd ..... 137/544 X 5,044,253 9/1991 Moody ..... 114/318 X

FOREIGN PATENT DOCUMENTS 0572109 3/1959 Canada ..... 114/319

0100257 8/1961 Netherlands ..... 114/238

*Primary Examiner*—Sherman Basinger

*Attorney, Agent, or Firm*—Michael J. McGowan; James F. Kasischke; Prithvi C. Lall

[57] ABSTRACT

A grate for a torpedo tube flow slot consists of a rigid metal frame and a wire chain link structure extending across the interior area of the frame. The chain link structure significantly reduces the surface area of the grate and permits greater flow through the flow slots. The dimensions of the frame are preferably larger than the flow area so that the frame structure does not block the flow path.

8 Claims, 3 Drawing Sheets

TORPEDO TUBE AND SLIDE VALVE GRATES

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

The instant invention relates to torpedo tube launch systems and more particularly to torpedo tube and slide valve grates for preventing weapon communication wires from falling through flow slots in the outer wall of the torpedo tube.

(2) Description of the Prior Art

Torpedo tube launch systems include an impulse tank which surrounds the breech end of the torpedo tube. The impulse tank is part of an ejection system that is operative for forcing water into the torpedo tube to eject a torpedo therefrom. Water from the impulse tank enters the torpedo tube through a plurality of circumferentially spaced flow slots formed in the wall of the torpedo tube. In this connection, an internal cylindrical slide valve is provided for closing the slots. The slide valve is actuated via a power cylinder which is located externally of the torpedo tube. Force is transmitted to the internal slide valve by diametrically opposed brackets which extend through two of the slots in the torpedo tube wall. Each of the torpedo tube slots is provided with a metal grate which extends across substantially entirely the area of the slot. The prior art metal grates comprise a rigid frame having a plurality of wide ribs extending back and forth between the frame. (See FIGS. 1 and 2). The metal grates are necessary because some torpedo weapons utilize communication wire and/or flexible hose systems to link a fired weapon to the ship for command and control purposes. As the communication wire/hose is payed out, the grates are operative for preventing the wire/hose from falling through the slots into the impulse tank where the wire/hose could foul the ejection system.

A typical ejection system provides six circumferentially spaced slots in the torpedo tube. The brackets for connecting the slide valve with the power cylinder extend through two diametrically opposed slots. In the four slots which are not obstructed by the power cylinder brackets, the metal grates (torpedo tube grates 10) are installed directly within the slot openings 12 (See FIG. 1). However, in the two slots 12 which are obstructed by the power cylinder brackets, the metal grates (slide valve grates 14) must be bolted to the breechward edge of the slide valve 16 within the interior of the torpedo tube. (See FIG. 2). In this manner, the slide valve grates 14 are moved into position over the slots 12 when the slide valve is moved to open the slots 12.

While the existing grates 10 and 14 are generally effective in preventing communication wire/hose from falling through the slots, it has been found that the surface area of the existing grates substantially decreases the flow area of the opening between the impulse tank to the torpedo tube. The surface area of the frames and ribs of the grates 10 and 14 effectively reduce the flow area by approximately 25%. In addition, the decreased flow area creates turbulent flow between the impulse tank and the interior of the torpedo tube, and further area creates unacceptable flow losses during system firing evolution. Still further, the turbulent flow causes unwanted acoustic vibration of the ribs.

SUMMARY OF THE INVENTION

It is an object of the instant invention to provide a protective grate for a torpedo tube flow slot having minimal surface area to restrict flow between the impulse tank and the torpedo tube interior.

It is another object to provide a simple and inexpensive grate construction which functions as effectively as the prior art grates.

It is another object to provide a grate construction for a torpedo tube flow slot which reduce flow losses and acoustic vibration.

The instant invention provides improved torpedo tube and slide valve grates which significantly reduce the flow blockage between the impulse tank and the torpedo tube interior. Briefly, the instant torpedo tube and slide valve grates comprise a rigid frame having a chain link mesh structure extending across the interior area of the frame. The chain link mesh structure significantly reduces the surface area of the grate and permits greater flow through the flow slots. In addition, the chain link mesh does not produce any acoustic vibration during flow. The dimensions of the frame are preferably larger than the flow area so that the frame structure does not block the flow path.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENTS

Figure 3:
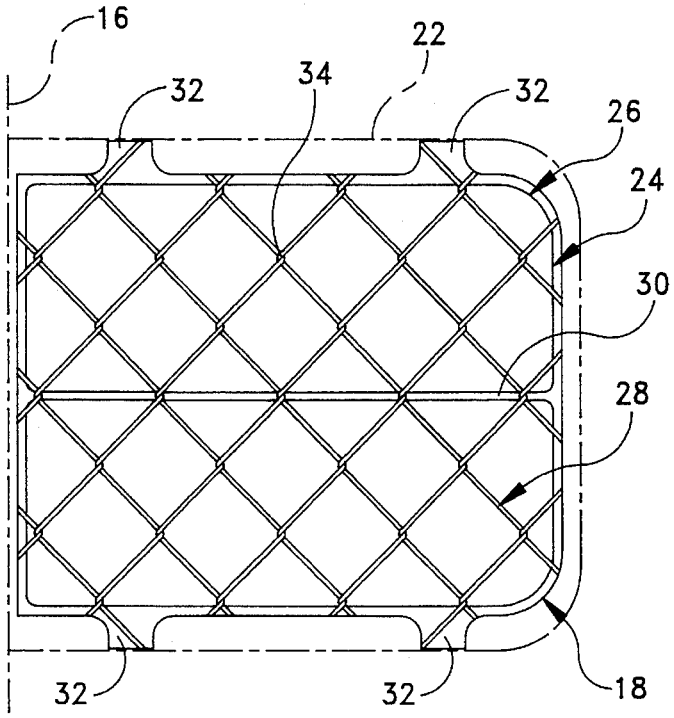
FIG. 3 is an elevational view of a first embodiment of a torpedo tube grate according to the instant invention.
Figure 4:
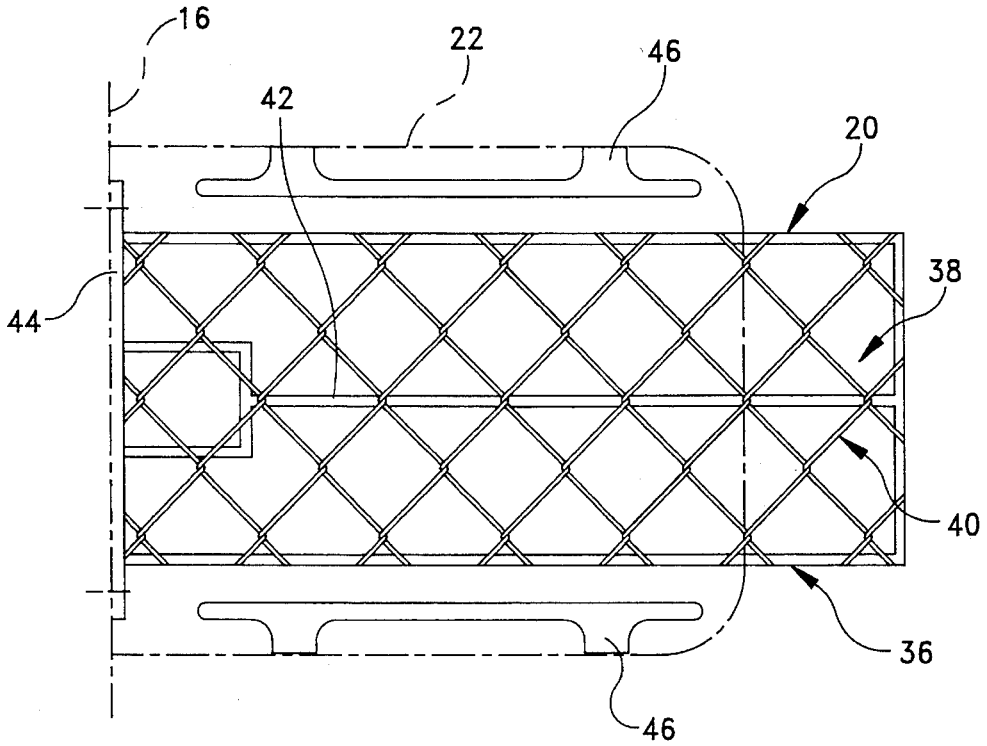
FIG. 4 is an elevational view of a first embodiment of a slide valve grate according to the instant invention.

Referring now to the drawings, first embodiments of a torpedo tube grate and a slide valve grate in accordance with teachings of the instant invention are illustrated and generally indicated at 18 and 20 in FIGS. 3 and 4. As will hereinafter be more fully described, the torpedo tube grate 18 and slide valve grate 20 are operative for preventing a communication cable (not shown) from falling through a flow slots 22 (shown in broken lines) in the wall of the torpedo tube (not shown) when a weapon (not shown) is launched therefrom.

Torpedo tube grate 18 (FIG. 3) comprises a rigid metal frame generally indicated at 24 defining an interior area generally indicated at 26, and further comprises a wire mesh structure generally indicated at 28 extending across interior area 26 of frame 24. Frame 24 is constructed from a suitable non-corrosive metal, such as stainless steel, and it includes a central stiffening rib 30. Frame 24 further includes outwardly extending flanges 32 for securing grate 18 within slot opening 22. Wire mesh structure 28 preferably comprises chain link material, such as chain link fencing, which is constructed from a non-corrosive material, such as stainless steel wire. Chain link material 28 preferably has a mesh size of about 2 inches by 2 inches and is preferably formed from a size 11 gauge wire (0.120 inch diameter). In order to provide stability and vibrational damping to the grate 18, and to reduce acoustic signaling, the locations 34 where the wires are wound around each other or wound around frame 24 are tack welded.

Figure 1:
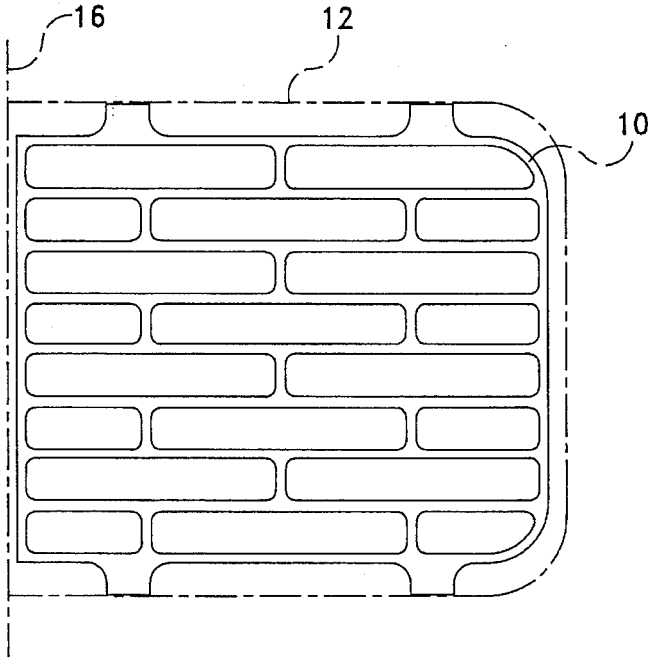
FIG. 1 (PRIOR ART)
FIG. 1 is an elevational view of a prior art torpedo tube grate.
Figure 2:
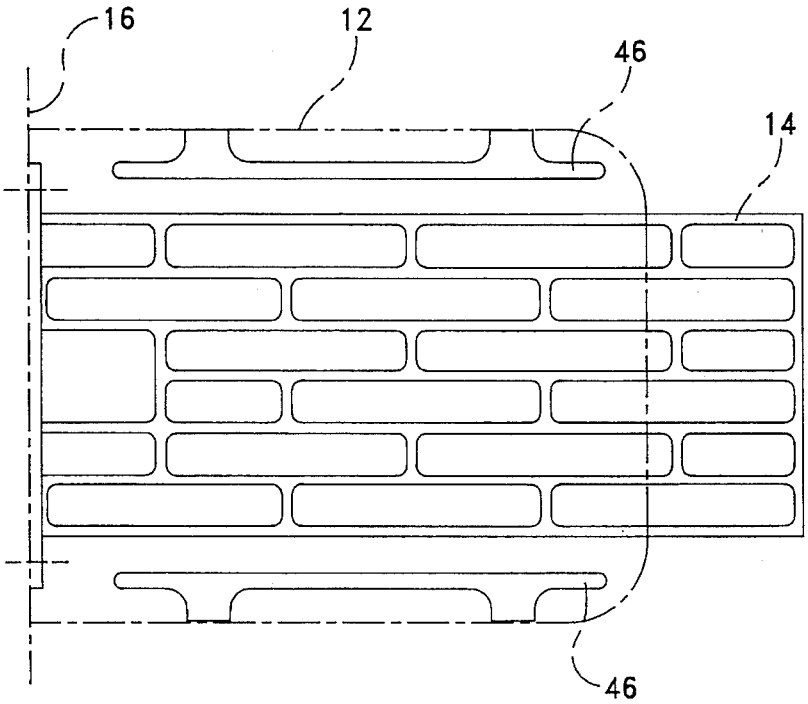
FIG. 2 (PRIOR ART)
FIG. 2 is an elevational view of a prior art slide valve grate.

Referring to FIG. 4, slide valve grate 20 is generally similar in construction to torpedo tube grate 18 wherein grate 20 comprises a rigid metal frame generally indicated at 36 defining an interior area generally indicated at 38, and further comprises a wire mesh structure generally indicated at 40 extending across interior area 38 of frame 36. Frame 36 also includes a central stiffening rib 42. Frame 36 still further includes an enlarged attachment rib 44 which facilitates attachment of grate 20 to the breechward edge of the slide valve 16 (shown in broken lines). As stated previously in the Background portion of this specification, slide valve grate 20 is secured to the breechward edge of the slide valve 16 so that it moves into position over slot 22 when the slide valve is opened. The two slots that require the use of slide valve grates 20 include side ribs 46 which are installed within slot opening 22 and extend inwardly therefrom (See FIG. 4). Since supporting frames 24 and 36 of grates 18 and 20 are similar in construction to the prior art frames (FIGS. 1 and 2), they can be installed in the same manner as the prior art frames. The grates 18 and 20 provide a significant advantage in that the internal rib elements which occupied a significant amount of flow area have been removed and are replaced by the chain link structure. It has been found that grates 18 and 20 as illustrated in FIGS. 3 and 4 reduce the flow path blockage from over 25% (prior art) to approximately 17% in the case of torpedo tube grate 18 and to approximately 23% in the case of slide valve grate 20.

Figure 5:
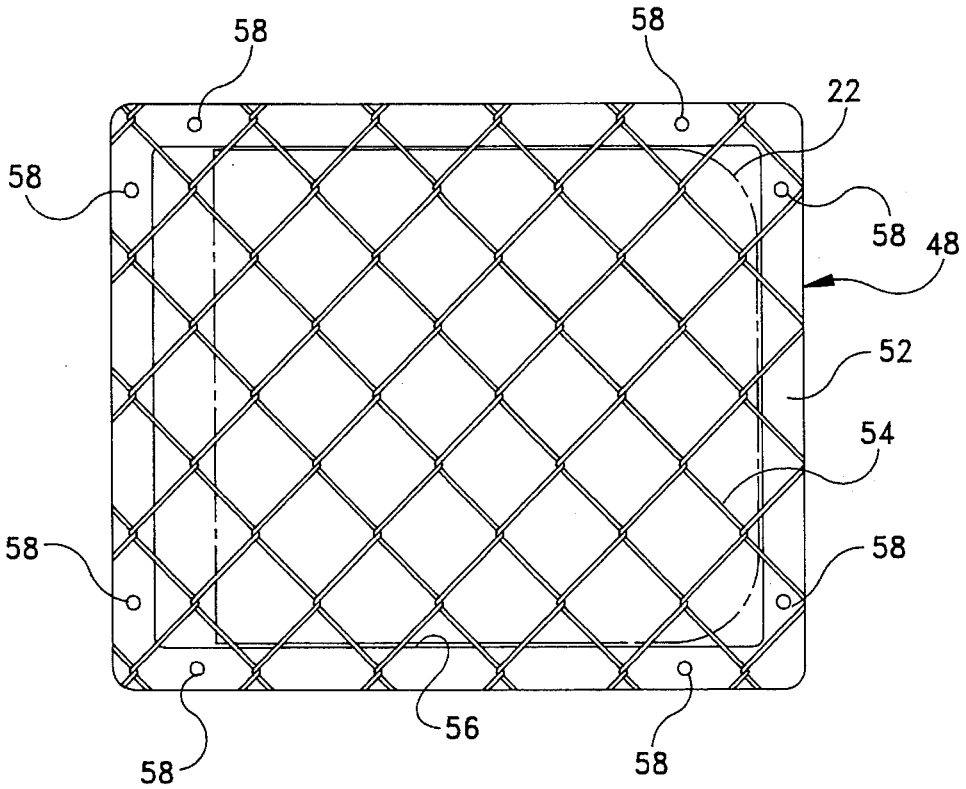
FIG. 5 is an elevational view of a second embodiment of a torpedo tube grate.
Figure 6:
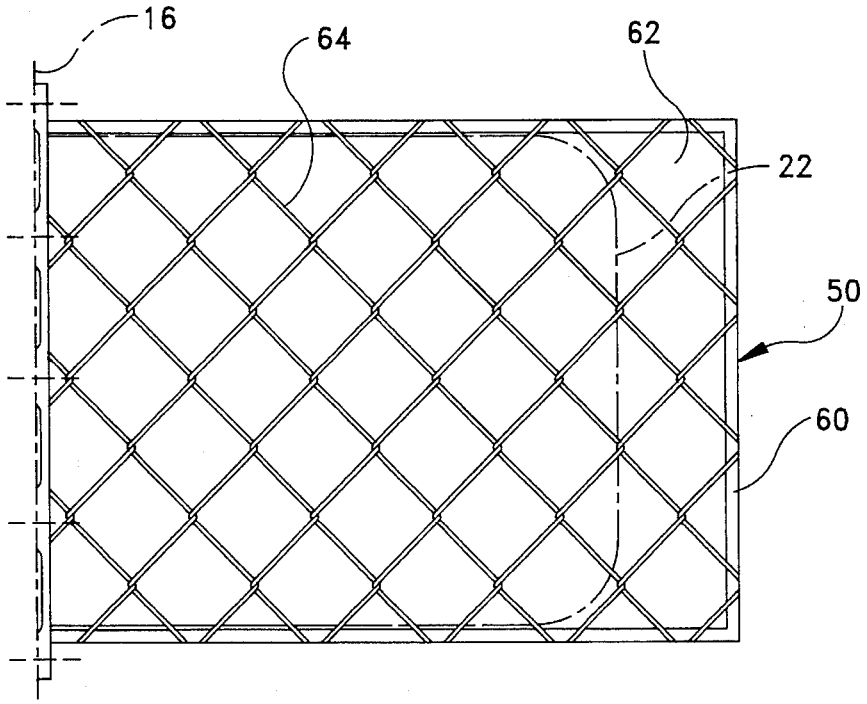
FIG. 6 is an elevational view of a second embodiment of a slide valve grate.

Referring now to FIGS. 5 and 6, second embodiments of a torpedo tube grate and a slide valve grate in accordance with the teachings of the instant invention are generally indicated at 48 and 50 respectively. Torpedo tube grate 48 and slide valve grate 50 are generally similar to the prior described embodiments 18 and 20. Torpedo tube grate 48 comprises a rigid frame 52 and a chain link structure 54 extending across an interior area of frame 52. However in contrast to frame 24, frame 52 is significantly larger in dimension. In this regard, the dimensions of frame 52 have been enlarged so that the interior area 56 defined by frame 52 is greater than the flow area of the flow slot 22. Since the frame structure is no longer located within the flow path, the flow area is only reduced by the surface area of chain link structure 54. One disadvantage to the enlarged grate design is that the torpedo tube grate 48 must be installed onto the outer surface of the torpedo tube within the impulse tank. Installation is accomplished by means of extending suitable fasteners 58 through the frame 52 and into the torpedo tube wall. However, this is not seen to be a major problem in that the intent of the design is to install the grates once, during ship construction.

Referring to FIG. 6, slide valve grate 50 comprises a frame 60 defining an interior area 62, and further comprises a chain link structure 64 extending across interior area 62. As can readily be seen in FIG. 6, the dimensions of frame 60 are also significantly enlarged so that the interior area 62 is greater than the flow area of the flow slot 22. Since the frame structure is no longer located within the flow path, the flow area is only reduced by the surface area of the chain link structure 64. Grates 48 and 50 effectively reduce the flow blockage from over 25% in the prior art to approximately 12% in each case.

It can therefore be seen that the instant invention provides novel torpedo tube and slide valve grates which significantly reduce flow blockage without sacrificing effectiveness. The simplified design of the grates also significantly reduces manufacturing costs. Furthermore, the chain link mesh structure essentially eliminates all acoustic vibration. For these reasons, the instant invention is believed to represent a significant advancement in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A protective grate for a torpedo tube flow slot having a predetermined flow area, said grate comprising:

a rigid frame defining an interior area;

a wire mesh structure secured to said rigid frame and extending across said interior area, said frame being secured to a breechward edge of a slide valve.

2. The protective grate of claim 1 wherein said frame defines an interior area which is greater than the flow area of said flow slot.

3. The protective grate of claim 2 further comprising means for securing said frame to an outside surface of said torpedo tube.

4. The protective grate of claim 2 wherein said wire mesh structure has a surface area which is less than 12% of said flow area.

5. A protective grate for a torpedo tube flow slot having a predetermined flow area, said grate comprising:

a rigid frame defining an interior area; and a wire mesh structure secured to said rigid frame and extending across said interior area, said wire mesh structure comprising a chain link structure having a plurality of individual chain link wires.

6. The protective grate of claim 5 wherein said chain link structure is tack welded at points where said chain link structure contacts said frame and where individual chain link wires contact each other.

7. The protective grate of claim 5 wherein a combined surface area of said frame and said wire mesh structure is less then 25% of said flow area.

8. The protective grate of claim 5 wherein said frame and said wire mesh structure are composed of corrosion resistant material.

* * * * *